US007404445B2

(12) United States Patent
Craig

(10) Patent No.: US 7,404,445 B2
(45) Date of Patent: Jul. 29, 2008

(54) PERIMETRICALLY LOADING COLLET

(75) Inventor: Daniel T. Craig, Fulshear, TX (US)

(73) Assignee: Baker Hughes Incorporated, Houston, TX (US)

( * ) Notice: Subject to any disclaimer, the term of this patent is extended or adjusted under 35 U.S.C. 154(b) by 283 days.

(21) Appl. No.: 11/123,981

(22) Filed: May 6, 2005

(65) Prior Publication Data

US 2005/0257935 A1 Nov. 24, 2005

Related U.S. Application Data

(60) Provisional application No. 60/572,918, filed on May 20, 2004.

(51) Int. Cl.
*E21B 23/00* (2006.01)

(52) U.S. Cl. ..... 166/380; 166/382; 166/255.1; 166/242.6

(58) Field of Classification Search ..... 166/255.1, 166/255.2, 241.6, 241.1, 242.1, 242.6, 242.7, 166/380, 382; 279/43, 43.1, 43.2, 43.5, 46.2, 279/46.3, 46.4, 46.5; 285/214, 321; 411/520, 411/521, 528, 529
See application file for complete search history.

(56) References Cited

U.S. PATENT DOCUMENTS 3,960,399 A 6/1976 Dufrene ..... 294/86.25
4,715,445 A 12/1987 Smith, Jr. ..... 166/377
4,793,411 A 12/1988 Zunkel ..... 166/98
4,951,746 A * 8/1990 Setterberg, Jr. ..... 166/114
5,335,737 A * 8/1994 Baugh ..... 175/61
5,605,366 A 2/1997 Beeman ..... 294/86.28
5,639,135 A 6/1997 Beeman ..... 294/86.28
5,730,224 A * 3/1998 Williamson et al. ..... 166/386
5,947,202 A 9/1999 Gazewood ..... 166/301
6,003,599 A * 12/1999 Huber et al. ..... 166/255.2
6,019,173 A 2/2000 Saurer et al. ..... 166/98
6,168,213 B1 * 1/2001 Muller ..... 285/391
6,173,796 B1 * 1/2001 McLeod ..... 175/257
6,230,797 B1 5/2001 Collins ..... 166/98
6,543,536 B2 * 4/2003 Dewey et al. ..... 166/255.2
6,648,071 B2 * 11/2003 Hackworth et al. ..... 166/207
7,066,270 B2 * 6/2006 Murray ..... 166/380
2003/0196819 A1 * 10/2003 Coon ..... 166/382
2004/0031604 A1 2/2004 Huggins et al. ..... 166/98

* cited by examiner

*Primary Examiner*—Jennifer H. Gay
*Assistant Examiner*—David Andrews
(74) *Attorney, Agent, or Firm*—Cantor Colburn LLP

(57) ABSTRACT

A perimetrically acting collet includes a body and at least one mating profile opening in the body. A plurality of resilient members located adjacent one side of the at least one mating profile opening and a profiled body is biased perimetrically by the plurality of resilient members.

14 Claims, 2 Drawing Sheets

PERIMETRICALLY LOADING COLLET

CROSS REFERENCE TO RELATED APPLICATIONS

This application claims the benefit of an earlier filing date from U.S. Provisional Application Ser. No. 60/572,918 filed May 20, 2004, the entire disclosure of which is incorporated herein by reference.

BACKGROUND

In the hydrocarbon exploration and recovery arts, a collet is a well known and and well used tool. Traditionally, collets have been configured to locate and/or lock and/or position tools in a borehole. These tools are invaluable with respect to confidence about an ongoing operation whether the purpose of the specific collet is locating, locking or positioning. As downhole tools become more complex however, with zones and seals ubiquitously positioned, and restrictions in the casing becoming more problematic, and with advanced tools (considered necessary to enhance production) needing to be run through the tubing, collets have in some instances been identified as a source of consternation. Further, because collets operate on a radial deflection principal (inward or outward) and because in general collets run in tubing operate on a deflection inward/bias outward principal, the collet fingers necessarily scrape the inside dimension of the tubing in which they are run. This creates little wear on the inside of a blank tube but can be deleterious to seals exposed at that inside dimension. Moreover, because modern downhole systems often include many profiles therein, whether intended as profiles or simply defacto profiles, conventional collets can become stuck. Therefore well operators must expend time and effort tracking the potential snags downhole before employing a conventional collet.

SUMMARY

Disclosed herein is a perimetrically acting collet which includes a body and at least one lug opening in the body. At least one resilient member is located adjacent the at least one lug opening and a profile in the body is biased perimetrically by the at least one resilient member.

Further disclosed herein is a collet having at least one profile therein, the profile acting perimetrically of a cross-sectional shape of the collet.

Yet further disclosed herein is a method for engaging a mating profile. The method includes approaching the mating profile with a perimetrically acting collet, perimetrically deflecting the collet and perimetrically engaging the mating profile.

BRIEF DESCRIPTION OF THE DRAWINGS

Referring now to the drawings wherein like elements are numbered alike in the several Figures.

DETAILED DESCRIPTION

Figure 1:
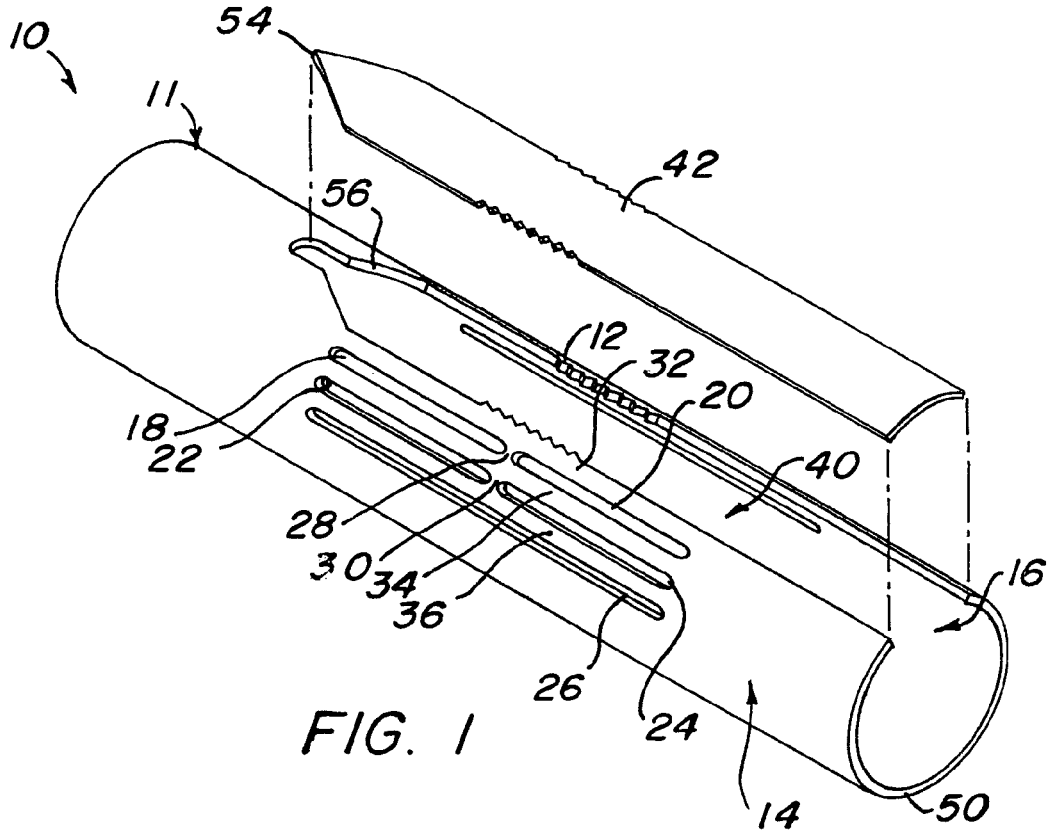
FIG. 1 is an elevation view of a circumferential collet as described herein.

Referring to FIG. 1, a circumferentially operating collet 10 is illustrated. As illustrated the device is circumferentially operating because it is circular in cross-section. It is to be noted however that this disclosure is directed to a peripherally acting collet because it is contemplated that specific embodiments may not be circular in cross-section. The collet as discussed herein does not act radially i.e., there is substantially no radial force (no more than incidental) in the engagement of the profile (discussed hereunder) but rather the force occurs around the perimeter of whatever cross-sectional shape the collet has. Collet 10 is, in the illustrated embodiment, of a tubular configuration. It is to be appreciated that collet 10 could be constructed from solid material or from material having one or more longitudinal openings that may or may not include an axial opening. In the event a solid material is employed, it would be machined to provide for the functional features that are described hereunder relative to the tubular embodiment shown.

Referring again to FIG. 1, collet 10 includes a body 11 having an engagement profile 12 which may comprise one or more teeth (as illustrated) or may comprise any profile capable of engagement with another structure. The structure (discussed below) may or may not have a complementary profile thereon but it will have a profile that is receptive of engagement profile 12. Profile 12 extends along a peripheral region of collet 10. The peripheral region may be proximate the exterior surface 14 of collet 10 or may occur somewhat radially inwardly thereof. Profile 12 is positioned such that it is resilient for engagement operations. In the illustrated embodiment, profile 12 extends from the outer surface 14 of collet 10 to an inside surface 16 of collet 10, that surface defining the tubular lumen of the tool.

Resiliency is effected in different, sometimes cumulative ways depending upon the construction of the collet 10. In the illustrated embodiment, the tube is closed at least in one of uphole and downhole of the mating profile opening 40 so that little resiliency is available in the body of the collet. In selective embodiments, discussed hereunder, some resiliency may also be available in the body of the collet since it will in cross-section be "C" shaped. In the embodiment illustrated in FIG. 1, resiliency is effected by removal of material from collet 10 "behind" the profile 12. Such material removal is illustrated in FIG. 1 as openings 18, 20, 22, 24 and 26. It will be noted that openings 18 and 20, 22 and 24 are respectively aligned and separated by a peripheral bridge 28, 30 extending between resilient members 32, 34 and 36 (again, respectively). In the illustrated embodiment, bridges 28, 30 are located directly "behind" profile 12. It will be appreciated that more bridges could be employed between resilient members and then could be alternately located between the resilient members. Bridges 28, 30 function to join resilient members to affect the character of the resilience afforded by the configuration. Character of resiliency is also affected by the number, radial thickness and perimetral width of each resilient member. Therefore, the degree of total resilience desired for the collet 10 is adjustable during manufacture by selecting inter alia, parameters for the resilient members and the number of resilient members.

Profile 12 must be at least on one side of mating profile opening 40 and some embodiments will have profiles 12 on both sides of mating profile opening 40. In embodiments having profiles on both sides, the profiles may be identical or may be different, as desired for a particular application.

Figure 2:
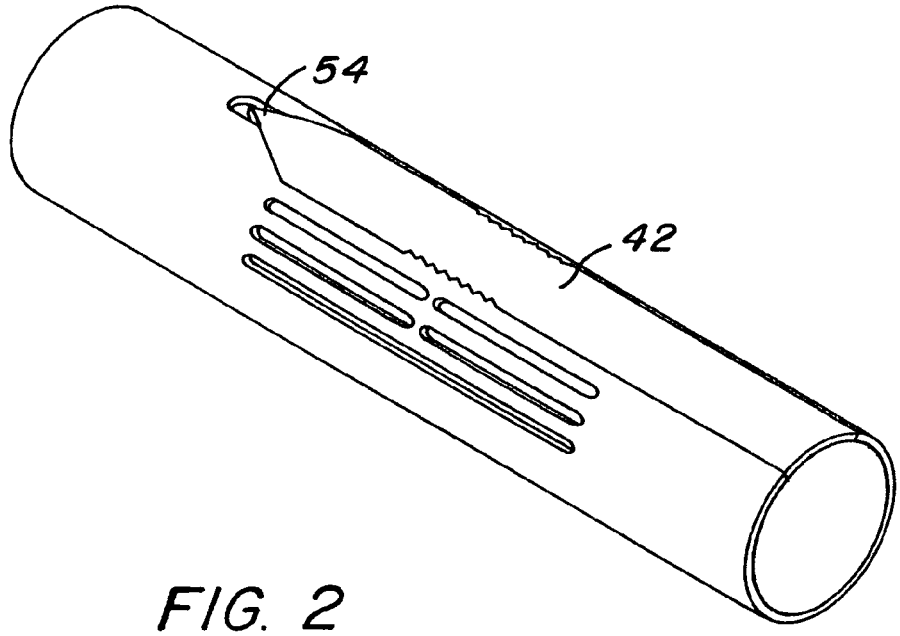
FIG. 2 is an elevation view of the collet of FIG. 1 engaged with a lug.

The mating profile opening 40 may be configured in a range of arc degrees of opening. The number of degrees selected will affect the size of a mating profile 42 (FIG. 2) that will engage therewith and affects the designed in resilience that is possible. As the opening grows in number of degrees past 90 degrees, a practical limit will be reached regarding resiliency available therefore reducing snap-out force to something below useful. In one embodiment (illustrated) an angle of arc of about 60 degrees is employed.

Figure 3:
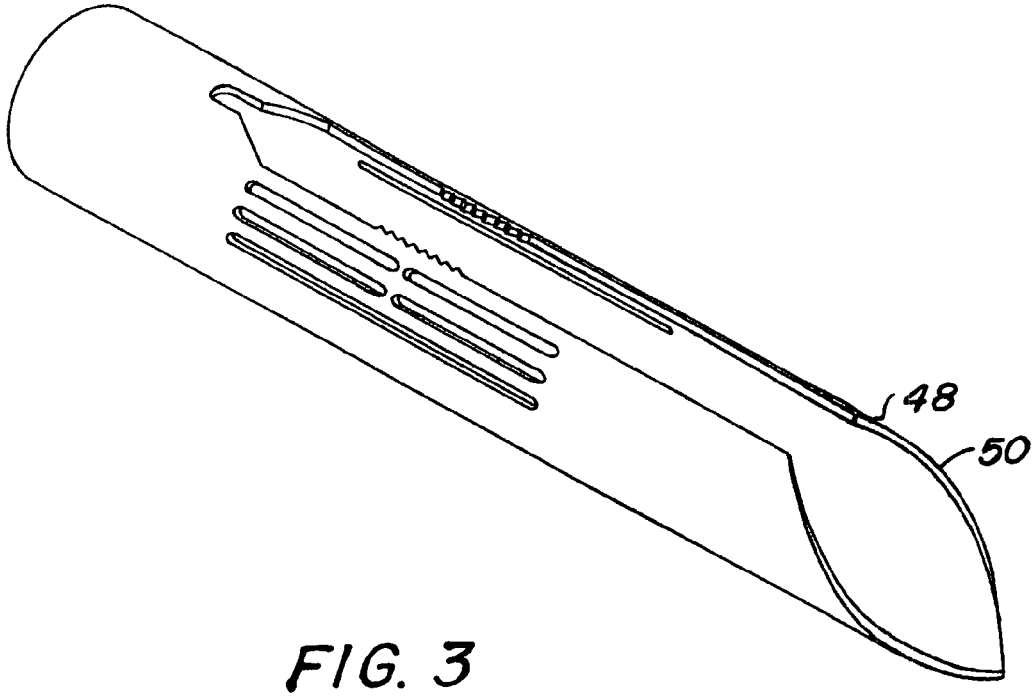
FIG. 3 is a perspective view of a collet with an orientation profile thereon.

Another feature of the collet 10 is that it may be employed as an orientation mechanism as well as a snap in/snap out engagement device. This is accomplished by adding a helical profile 48 to the downhole end 50 of collet 10 (see FIG. 3). The helical profile 48 will cooperate with mating profile, in this case a lug 42 to orient the collet 10 and any tool connected thereto. A lug 42 having a pointed leading end 54 as shown is of benefit for an orientation operation since it enhances the action of following the helical profile 48, end 54 also provides for a positive stop of the tool when the end 54 reaches an end 56 of lug opening 40.

Figure 4:
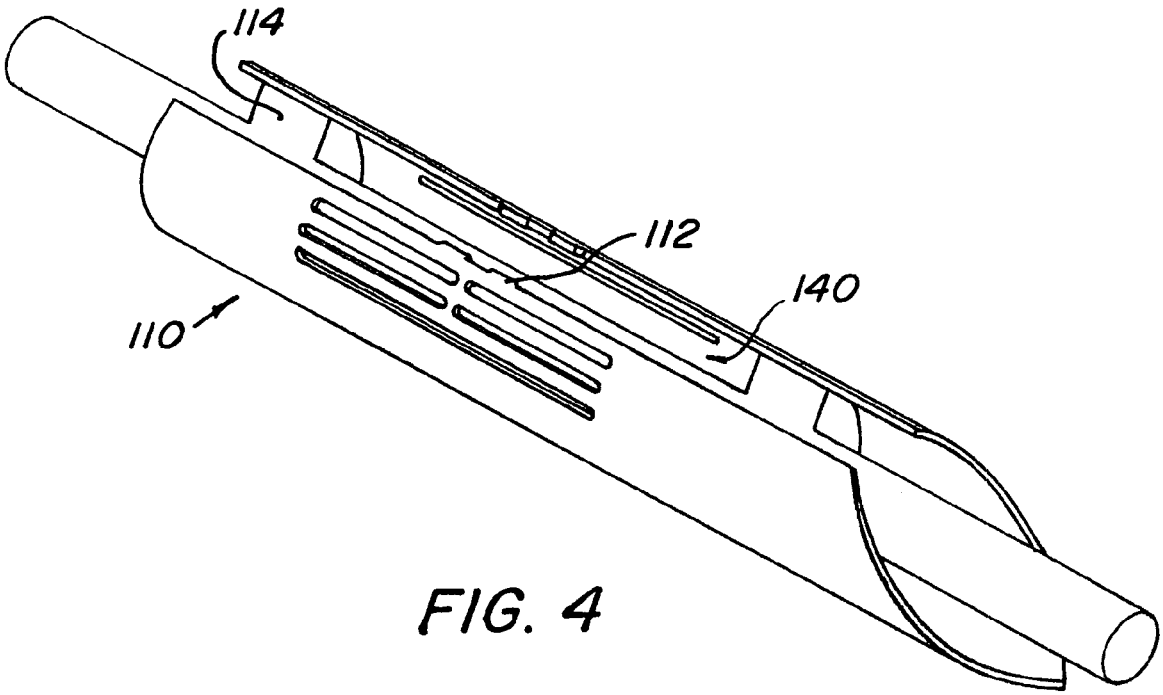
FIG. 4 is a view of an alternate selective collet embodiment.

In an alternate embodiment of collet 10, illustrated in FIG. 4, the collet 110 is configured as a selective device which has the capability of passing over non-conforming mating profiles. In order to pass over such non-conforming mating profiles there must not be end 56 (FIG. 1) which would otherwise act as a positive stop, preventing the collet 110 from passing over. In the selective collet embodiment, provision is made in the profile to provide a positive stop if desired. One such positive stop profile is illustrated in FIG. 4 as 112, a no-go shoulder selective profile.

Because collet 110 includes a lug opening 140 that extends the length thereof embodiments which exist in tubular form will benefit from being fixed to other tools thereby lending additional structural support. This is illustrated schematically in FIG. 4 where the collet 110 is shown mounted to a structural support 114 which may be another tool or simply a support mode for collet 110. In more solid embodiments however, there is no need to affix the collet 110 to another tool for support reasons.

While preferred embodiments have been shown and described, modifications and substitutions may be made thereto without departing from the spirit and scope of the invention. Accordingly, it is to be understood that the present invention has been described by way of illustrations and not limitation.

What is claimed is:

1. A perimetrically acting collet comprising:

a body;

at least one mating profile opening in the body;

a plurality of resilient members and a plurality of resilient member openings adjacent one side of the at least one mating profile opening, at least one of the plurality of resilient member openings having at least one bridge; and a profile in the body, biased perimetrically by the plurality of resilient members.

2. A perimetrically acting collet as claimed in claim 1 wherein the plurality of resilient members comprises a part of the body of the collet.

3. A perimetrically acting collet as claimed in claim 1 wherein the plurality of resilient member openings is three resilient member openings adjacent each other.

4. A perimetrically acting collet as claimed in claim 1 wherein the collet further includes a helical profile capable of orienting the collet when contacting a mating profile.

5. A perimetrically acting collet as claimed in claim 1 wherein the mating profile opening has a positive stop feature.

6. A perimetrically acting collet as claimed in claim 1 wherein the profile is complementary to a mating profile.

7. A perimetrically acting collet as claimed in claim 1 wherein the profile is teeth.

8. A perimetrically acting collet as claimed in claim 1 wherein the profile includes a positive stop feature complementary to a shape of a member receivable therein.

9. A perimetrically acting collet as claimed in claim 1 wherein the collet is a selective collet configured to pass non-complementary mating profiles and positively stop at a complementary mating profile.

10. A perimetrically acting collet as claimed in claim 1 wherein the mating profile opening is about 60 degrees of arc measured around the periphery of the body.

11. A perimetrically acting collet as claimed in claim 1 wherein the body includes a helical profile on a leading longitudinal end thereof.

12. A perimetrically acting collet as claimed in claim 1 wherein the at least one bridge affects the perimetrical bias that the plurality of resilient members places on the profile in the body.

13. A method for engaging a mating profile downhole comprising:

approaching the mating profile with a perimetrically acting collet, the collet having a plurality of resilient members and a plurality of resilient member openings adjacent one side of at least one mating profile opening, at least one of the plurality of resilient member openings having at least one bridge;

perimetrically deflecting the collet; and perimetrically engaging the mating profile.

14. A method for engaging a mating profile downhole as claimed in claim 13 wherein the method further comprises stopping traveling movement of the collet by a stop.

* * * * *